United States Patent [19]

Georgiev et al.

[11] 4,272,023

[45] Jun. 9, 1981

[54] TELESCOPIC SINKING HYDRANT

[75] Inventors: Vesselin Y. Georgiev; Vladimir S. Mednikarov, both of Sofia, Bulgaria

[73] Assignee: Institute po Mechanika i Biomechanika, Sofia, Bulgaria

[21] Appl. No.: 35,541

[22] Filed: May 3, 1979

[30] Foreign Application Priority Data

Oct. 30, 1978 [BG] Bulgaria ..... 41257

[51] Int. Cl.[3] ..... B05B 15/10

[52] U.S. Cl. ..... 239/204

[58] Field of Search ..... 239/203, 204, 205, 206

[56] References Cited

U.S. PATENT DOCUMENTS

| | | | |
|---|---|---|---|
| 2,501,910 | 3/1950 | Oughton | 239/204 |
| 2,912,111 | 11/1950 | Kovac | 239/204 X |
| 3,529,773 | 9/1970 | Barnum | 239/204 |

FOREIGN PATENT DOCUMENTS

| | | | |
|---|---|---|---|
| 2201718 | 7/1973 | Fed. Rep. of Germany | 239/204 |

*Primary Examiner*—Richard A. Schacher

*Attorney, Agent, or Firm*—Karl F. Ross

[57] ABSTRACT

A two-stage retractable sprinkler comprises a first-stage riser tube, with inner and outer walls forming an annular peripheral channel and with a first piston head at its open lower end guided in a stationary cylinder, and a second-stage riser tube with a second piston head at its closed lower end guided in the first-stage tube. The second piston head has a peripheral groove communicating with an axial bore of its tube through radial holes through which water entering the bottom of the guide cylinder can pass to an outlet at the top of the second-stage tube by way of a set of vertical slots, formed near the top of the inner wall of that tube, after both tubes have been elevated by the water pressure. The slots are sealed from without by a sleeve in the annular channel which has external flutes forming passages for the retraction of the second-stage tube under water pressure and for the escape of water from the closed top of the first-stage tube, via other radial holes in the inner and outer walls thereof, when the second-stage tube is extended.

4 Claims, 2 Drawing Figures

TELESCOPIC SINKING HYDRANT

FIELD OF THE INVENTION

This invention relates to a retractable two-stage sprinkler to be used in stationary rural irrigation systems for high-stem farm products.

BACKGROUND OF THE INVENTION

A known sprinkler of this type comprises a stationary guide cylinder which is connected to a primary and a secondary water-supply conduit and surrounds two telescopically interfitted riser tubes, i.e. a double-walled outer first-stage tube and an inner second-stage tube in which there is mounted a movable piston for remote control of the operation of the sprinkler.

The drawbacks of the known retractable two-stage sprinkler lie in the presence of axial bores in the pistons of both telescopic stages through which water flows out ineffectively when the tubes are raised above the ground surface, thus reducing considerably the lifting force of the pistons, as well as in the need for a movable piston with remote control in the second stage, which requires frequent resetting and reduces the operational reliability of the sprinkler.

In our copending application Ser. No. 029,476, filed Apr. 12, 1979, there has been disclosed a single-stage retractable spray head or sprinkler with a hollow piston whose axial bore is connected by means of radial holes to an annular groove in the external surface of the piston head, the upper part of the guide cylinder surrounding that piston having two sets of radial holes on different levels which are embraced from the outside by a ring chamber.

OBJECT OF THE INVENTION

The object of our present invention is to provide an improved two-stage sprinkler of the general type referred to which fully utilizes the available water pressure of an associated conduit system and, in its extended position, prevents water leakage without the need for an external ring chamber of the kind disclosed in our above-identified copending application.

SUMMARY OF THE INVENTION

We realize this object, in accordance with our present invention, by the provision of a set of vertical slots near the closed upper end of the inner peripheral wall of the double-walled first-stage riser tube which, in a fully elevated relative position of the second-stage riser tube with a piston head thereof contacting that upper end, extend between the space underneath this piston head and an annular peripheral groove thereof. The groove, in turn, communicates through a set of radial holes with the interior of the second-stage tube and thus with an outlet at the top of the latter tube, the slots being externally closed by a sleeve which is located in the annular channel formed by the walls of the first-stage tube and is provided with vertical passages such as external flutes. Together with another set of radial holes present in the inner tube wall above the slots and a further set of radial holes near the bottom of the outer tube wall, these passages provide a flow path for the escape of water trapped above the piston head of the second-stage tube in the last phase of its rising stroke, when both tubes are elevated by water pressure from a main conduit opening into the bottom of the guide cylinder, and for the retraction of the second-stage tube by water pressure from an ancillary conduit opening into the top of that cylinder.

BRIEF DESCRIPTION OF THE DRAWING

The above and other features of our present invention will now be described in detail with reference to the accompanying drawing in which.

SPECIFIC DESCRIPTION

Figure 1:
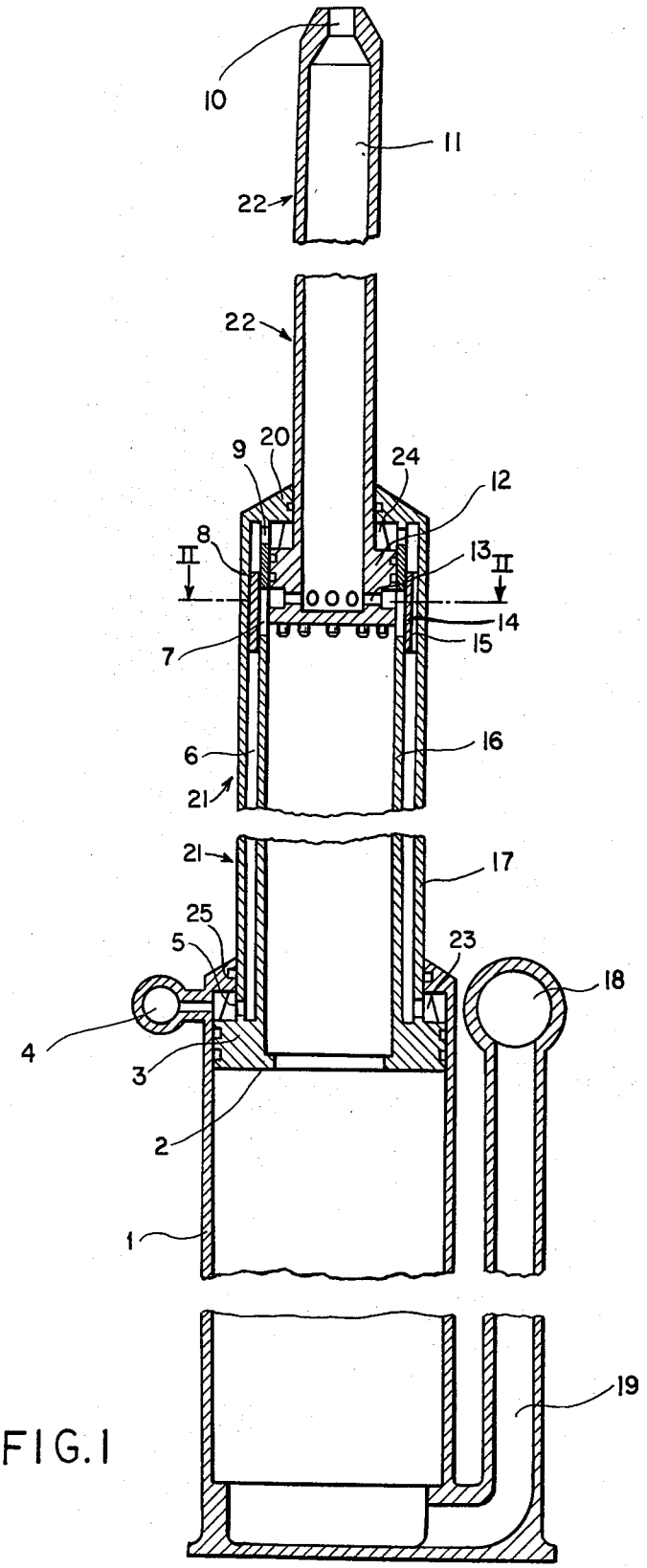
FIG. 1 is a cross-sectional view along the axis of a telescopic two-stage sprinkler embodying our invention.
Figure 2:
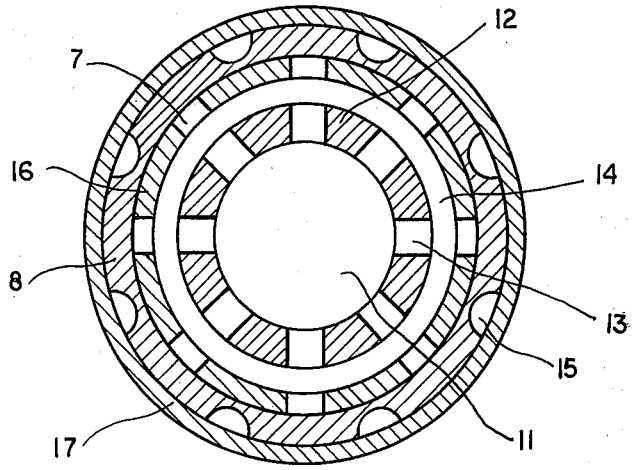
FIG. 2 is a cross-sectional view along line II—II of FIG. 1.

In the drawing we have shown a two-stage sprinkler comprising a stationary cylinder 1 for the guidance of a piston head 3 at the lower end of a first-stage (outer) riser tube 21 having inner and outer peripheral walls 16 and 17 which define an annular channel 6 between them. Tube 21 has a closed upper end 20 penetrated by a second-stage (inner) tube 22 whose axial bore 11 terminates at the top in an outlet 10 and is closed at the bottom by a piston head 12, except for a set of radial holes 13 by which bore 11 communicates with an annular peripheral groove 14 of this piston head. The piston head 3 of tube 21 is downwardly open but internally restricted by an annular shoulder 2. Stops 23 and 24 of piston heads 3 and 12 abut the top 25 of cylinder 1 and the upper end 20 of tube 21, respectively, when the sprinkler is fully extended above ground with both tubes in their fully elevated positions as shown in FIG. 1.

The bottom of guide cylinder 1 has a port communicating with a main or primary supply conduit 18 through a branch pipe 19; an ancillary or secondary supply conduit 4 communicates via another port with a clearance maintained by the stops 23 between the top 25 of the cylinder and the elevated piston head 3. A set of radial holes 5 in the outer tube wall 17, just above its junction with piston head 3, connects that clearance with channel 6 whose upper end communicates with a similar clearance, formed by the stops 24 between tube end 20 and piston head 12 in the elevated position thereof, via another set of radial holes 9 in the inner tube wall 16. The latter wall is further provided, below the level of holes 9, with a set of vertical slots 7 whose upper boundaries are flush with that of groove 14 in the illustrated top position of piston head 12 and whose lower boundaries then lie below the undersurface of this piston head whereby a flow path is established between the interior of tube 21 and bore 11 of tube 22. The slots 7 are externally closed by a surrounding sleeve 8 located in channel 6, this sleeve having vertical outer flutes 15 whereby water trapped above piston head 12 in the final phase of its ascent can escape through holes 9, flutes 15 and channel 6 into the clearance above piston head 3.

The operation of the telescopic sprinkler in accordance with the invention is as follows:

When the water pressure in the main supply conduit 18 is turned on, the water enters through branch pipe 19 into the space below the piston head 3 in the stationary cylinder 1 and begins to lift the first-stage tube 21 and the second-stage tube 22 of the telescopic sprinkler. When tube 11 reaches its upper limiting, water passes through the slots 7 in the inner wall 16 of tube 21 and through the ring groove 14 as well as radial holes 13 of piston head 12 into the axial bore 11 of tube 22 and thence to a nonillustrated irrigation attachment supported thereby. The water from the spaces above the piston heads 12 and 3 of stages 22 and 21 is forced, respectively, through the radial holes 9, the vertical grooves 15 of sleeve 8 and annular channel 6 as well as through the radial holes 5 into the ancillary conduit 4. To retract the telescopic tubes into the stationary cylinder 1, the water pressure in conduit 4 is turned on whereupon the water enters the space above the piston head 3 and then passes through the holes 5, the vertical flutes 15 and the holes 9 into the space above piston head 12. Piston head 3 comes to rest on the bottom of the stationary cylinder 1 whereas piston head 12 seats on shoulder 2 of stage 21 while the water from the spaces under the two piston heads is forced through branch pipe 19 into the main supply conduit 18.

What we claim is:

1. A retractable sprinkler for an irrigation system having main and ancillary conduit means alternately supplied with water under pressure; comprising:

a stationary cylinder communicating at its bottom with said main conduit means and at its top with said ancillary conduit means;

a first-stage riser tube having an open lower end with a first piston head guided in said cylinder for vertical reciprocation under water pressure from said main and ancillary conduit means between a retracted position near the cylinder bottom and an elevated position near the cylinder top, said first-stage tube having an inner and an outer peripheral wall defining an annular channel therebetween;

a second-stage riser tube having a closed lower end with a second piston head guided in said inner wall for vertical reciprocation under said water pressure between a retracted and an elevated position relative to said first-stage tube, said second-stage tube penetrating an otherwise closed upper end of said first-stage tube and having an axial bore terminating in an outlet at the top thereof;

first stop means in said cylinder defining a first clearance between the cylinder top and said first piston head in the elevated position of the latter, said first clearance being open to said ancillary conduit means and communicating with said annular channel through a set of first radial holes near the lower end of said outer wall;

second stop means in said first-stage tube defining a second clearance between said upper end thereof and said second piston head in the elevated relative position thereof, said inner wall being provided near said upper end with a set of second radial holes connecting said second clearance with said annular channel, said axial bore being connected at the bottom thereof via a set of third radial holes with an annular peripheral groove of said second piston head, said inner wall being further provided below said second radial holes with a set of vertical slots extending in the elevated relative position of said second-stage tube from the level of said peripheral groove to a level below the undersurface of said second piston head whereby a flow path for incoming water is formed in the elevated positions of said tubes from said main conduit means via said cylinder, the open lower end of said first-stage tube, said slots, said peripheral groove, said third radial holes and said bore to said outlet; and a sleeve in said channel closing said slots from without, said sleeve having vertical passages forming with said first and second radial holes a flow path extending to said ancillary conduit means for the retraction of said second-stage tube under water pressure from the latter conduit means and for the escape of water trapped in said second clearance upon an ascent of said second-stage tube under water pressure from said main conduit means.

2. A sprinkler as defined in claim 1 wherein said passages are flutes on the outer periphery of said sleeve.

3. A sprinkler as defined in claim 1 or 2 wherein said slots have upper boundaries flush with that of said peripheral groove in said elevated relative position of said second-stage tube.

4. A sprinkler as defined in claim 1 or 2 wherein said first piston head is provided with an internal annular shoulder forming a seat for said second piston head in said retracted relative position of said second-stage tube.

* * * * *